US006004357A

United States Patent [19]

Dohmen

[11] Patent Number: 6,004,357

[45] Date of Patent: Dec. 21, 1999

[54] PROCESS FOR DYEING TEXTILE MATERIAL HAVING POLYESTER FIBERS

[75] Inventor: Mark Dohmen, Vira, Switzerland

[73] Assignee: M. Dohmen GmbH, Germany

[21] Appl. No.: 09/210,320

[22] Filed: Dec. 11, 1998

[30] Foreign Application Priority Data

Dec. 15, 1997 [DE] Germany ..... 197 55 647

[51] Int. Cl.[6] ..... D06P 3/54

[52] U.S. Cl. ..... 8/597; 8/630; 8/922

[58] Field of Search ..... 8/597, 630, 922

[56] References Cited

U.S. PATENT DOCUMENTS 4,509,992 4/1985 Higgins .
5,019,133 5/1991 Himeno et al. .

FOREIGN PATENT DOCUMENTS 39 38 631 A1 5/1990 Germany .
5-140877 6/1993 Japan .
6-136670 5/1994 Japan .

*Primary Examiner*—Margaret Einsmann
*Attorney, Agent, or Firm*—Mason, Kolehmainen Rathburn & Wyss

[57] ABSTRACT

In a process for dyeing textile material including polyester fibers, the textile material is treated in an alkaline dye bath containing a dispersion dyestuff at a temperature above 100° C. The pH-value of the dye bath is adjusted by the initial addition of a buffer mixture preferably comprising glycine and soda lye prior to the commencement of the dyeing operation. A perborate salt such as sodium perborate is also added. The pH-value is kept substantially constant from the beginning to the end of the dyeing operation. A sequestering agent including nitrilotriacetic acid and polycarboxylates can be alternatively or additionally added to the dye bath.

11 Claims, No Drawings

PROCESS FOR DYEING TEXTILE MATERIAL HAVING POLYESTER FIBERS

BACKGROUND OF THE INVENTION

1. Field of the Invention

The invention concerns a process for dyeing textile material having polyester fibers.

2. Background of the Invention

In a typical form of process for dying textile material including polyester fibers, the textile material is treated in an alkaline dye bath containing a dispersion dyestuff, at a temperature above about 100° C. In that respect it will be noted that polyester dyeing processes involving a temperature above about 100° C., which are therefore implemented under an increased pressure, make it possible to achieve shorter dyeing times than when operation is implemented under normal pressure. In addition, the quality of dyeing penetration, the compensatory effect in respect of fixing and stretching differences, the dyeing yield and the degrees of color fastness are improved under high-temperature (HT) conditions. However, under HT conditions, the dyeing processes which are usually employed, involving an acid dye bath, suffer from the following problem: during the dyeing procedure, low-molecular oligomers are liberated from the interior of the fibers, and they occur as by-products in the operation for spinning endless polyester fibers. Those low-molecular oligomers are deposited in the acid dye bath upon cooling of the dye liquor on the fiber surface and at the surfaces of the dyeing equipment. Those deposits considerably impair the technical properties of the textile material such as for example the running properties and the feel thereof. In addition the dyeing equipment is soiled and contaminated by the oligomer deposits. Furthermore reductive or alkaline cleaning procedures are required when dealing with dark color shades, when using an acid dye bath.

For that reason the use of alkaline dye baths has been proposed. The solubility of the oligomers is enhanced when operating under alkaline conditions. Furthermore, operating under alkaline conditions provides for partial saponification of the liberated oligomers, whereby the undesirable deposits referred to above are considerably reduced. Moreover, when using alkaline dyeing, it is in many cases possible to forego reductive or alkaline post-treatment. When employing the acid dye baths which are currently known the dyeing procedure generally represents the sole treatment stage in an acid medium. Accordingly, alkaline dying means that it is possible to avoid a change in pH-value and thus the risk due to entrained alkali can be minimised. A further advantage in this respect is that single-bath dyeing processes of polyester-cellulose fiber mixes using direct dyestuffs also become possible when operating in an alkaline dye bath, and that affords additional options in terms of the choice of suitable direct dyestuffs. Furthermore, when using an alkaline dye bath, it is basically possible to combine the dyeing operation and the operation of washing or desizing polyester materials in one bath. Furthermore recrystallization of fiber decomposition products from splitting and peeling procedures is impeded by the alkali.

However various problems arise in connection with alkaline dyeing, and they can result in unsatisfactory dyeing results, as follows:

On the one hand the hoped-for reduction in oligomer deposits when using alkaline dye baths is frequently not achieved.

Furthermore, the dispersion dyestuffs used in an acid dye bath are in part unstable when used in an alkaline dye bath.

In that respect, destruction of the dyestuffs occurs due to the hydrolysis of ester compounds in the side chains of the dyestuff molecule. The degree of such hydrolysis is largely dependent on the pH-value of the dye bath throughout the entire dyeing procedure. In known processes the pH-value is subject to fluctuations which can lead to non-reproducible dyeing results. A further problem is represented by heavy metal ions and polyvalent metal ions in the dye bath, the presence of which cannot be reliably excluded in varying levels of concentration when operating on a large engineering scale. The influence of the heavy metal ions and the metal ions (for example $Cu^{2+}$, $Fe^{2+}$) on the dyeing result is generally considerably greater when operating with an alkaline dye bath than with an acid dye bath. The influence of constituents such as salts causing hardness in the water of the dye bath on the dyeing result when operating in an alkaline mode is also substantially greater than when operating in an acid mode. Further substances such as for example glucose as a decomposition product of sizing esters can have an adverse influence on the dyeing result in an alkaline procedure. The stronger influence of the above-mentioned substances when operating in an alkaline bath is in part due to the fact that the reduction potential in an alkaline procedure is always greater than in an acid procedure so that irreversible reduction of the dyestuffs can occur.

Furthermore the level of concentration of the adjuvant substances which are dissolved in the dye bath is limited by virtue of the fact that, at an excessively high level of concentration, the dispersion dyestuffs which are generally difficult to dissolve can no longer be held in solution, in spite of the use of dispersing agents.

DE 39 38 631 A1 discloses a process for dyeing polyester-bearing textile material in an alkaline dye bath, which involves adding to the dye bath an amino acid or an amino acid derivative and an alkali metal salt of the amino acid or the amino acid derivative. It has been found however that this process cannot satisfactorily resolve the above-indicated problems.

SUMMARY OF THE INVENTION

An object of the present invention is to provide an improved process for dyeing textile material comprising polyester and fiber mixes thereof, which can obviate the problems outlined above.

Another object of the present invention is to provide a process for dyeing textile material including polyester fibers, which operates in such a way as to at least reduce the deposit of oligomers on material to be dyed and dyeing equipment.

Still a further object of the invention is to provide a process for dyeing polyester fiber-containing textile material which can afford a dyeing result that can be reproduced on a large scale and which can be persistently of high quality.

Yet another object of the present invention is to provide a process for dyeing polyester fiber-containing textile material which involves the use of a simple operating procedure and readily available constituents.

Yet a further object of the present invention is to provide a dyeing adjuvant which is adapted to at least in part remedy the above-outlined problems encountered in prior processes.

In accordance with the process aspect of the present invention, the foregoing and other objects of the invention are attained by a process for dyeing textile material having polyester fibers, wherein the textile material is treated in an alkaline dye bath containing a dispersion dyestuff, at a temperature above about 100° C. The pH-value of the dye bath is adjusted by the addition of a buffer mixture comprising at least glycine and/or a glycine derivative and a lye prior to the commencement of the dyeing procedure. A perborate salt is added to the dye bath.

In a preferred embodiment of the invention the pH-value of the dye bath is adjusted by the initial addition of a buffer mixture of glycine and soda lye, or caustic soda solution, prior to the commencement of the dyeing procedure, and sodium perborate is added to the dye bath prior to the commencement of the dyeing procedure so that the pH-value is kept substantially constant by the effect of the buffer mixture from the commencement to the conclusion of the dyeing procedure.

This mode of operation thus involves a dual buffer system which ensures adequate constancy of the pH-value up to the conclusion of the dyeing procedure and which at the same time opposes reductive processes without the dispersion dyestuff being displaced out of the solution by the buffer substances.

The invention is based inter alia on the surprising realisation that the pH-value is not kept sufficiently stable in known alkaline dying processes. Particularly due to the oligomer saponification effect the pH-value which is set at the commencement decreases due to the consumption of alkali towards the end of the dyeing procedure, with the consequence that initially saponified and dissolved oligomers precipitate again. That effect is counteracted by a powerful buffer mixture. In addition undesirable changes in the pH-value due to acid or alkaline constituents in the dye bath are prevented by the buffer system, whereby the invention affords a uniform dyeing result.

In another preferred embodiment, the buffering effect is achieved on the one hand by using a glycine/soda lye buffer (or a glycine/glycine-alkali metal salt buffer) which chemically operates in the following fashion:

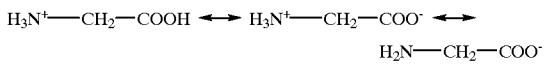

(1)

The protonized form of both terminal groups occurs only in the acid mode and the deprotonized form occurs only in the alkaline mode. The amphoteric ion is deprotonized to the amine by addition of the soda lye. Besides or instead of NaOH, it is also possible to envisage using another lye, for example sodium carbonate or $Na_3PO_4$. It has been found however that the best level of dyestuff stability is achieved by means of NaOH with the same pH-value in each respective case.

It was possible to demonstrate by experimental variations in the glycine/soda lye ratio that glycine and soda lye co-operate in accordance with the invention as a buffer to afford constancy of pH-value to the conclusion of the dyeing procedure. The dyeing result was precisely at its optimum when the above-mentioned constituents were added to the dye bath in a ratio which is predetermined by the corresponding buffer equation for the desired pH-value. If the ratio is displaced towards the alkali, that is to say a pH-value of greater than 9.5 is produced, it is found that the dyestuffs suffer from instability, in other words the dyeing effect is not readily reproducible. If on the other hand the ratio is displaced to the favour of the glycine, the buffer capacity is no longer adequate and the final pH-value is clearly below 9.0, which results in re-deposition of the oligomers or the decomposition products thereof.

In accordance with the invention it is possible to use both glycine and also a glycine derivative in which a hydrogen of the amino group is replaced by an organic group. Unsubstituted glycine is found to be particularly advantageous as the use of a glycine derivative increases the difficulty involved in acceptance of a further proton for acidification, which slows down adjustment of the buffer equilibrium. The hydrophobic residues of a substituted amino group also exhibit an increased dispersion effect by virtue of which the dispersion dyestuff is held for longer in the dye bath and thus the dyeing procedure is increased in length.

Experiments have also shown that the pH-value cannot be kept sufficiently constant in every case with a glycine/soda lye buffer. This is due to the fact that the available buffer capacity is limited by virtue of the fact that, at high levels of concentration of the buffer substances, the dispersion dyes which are preferably used would precipitate out of the dye bath in spite of the use of dispersing agents. The maximum available buffer capacity of the glycine/soda lye buffer however is not sufficient to keep the pH-value sufficiently constant until the end of the dyeing procedure, with a high level of oligomer production. Therefore, in accordance with the invention, in order to be able to reproducibly implement the dyeing process on a large technical scale even when a relatively high level of oligomer production is involved, a perborate salt, preferably sodium perborate, is additionally added to the dye bath, in such a fashion that, at the dyeing temperature, hydrogen peroxide as an oxidation agent and a pH-stabilizing mixture of borax and soda lye is liberated in accordance with the following equation:

$$4NaBO_3+5H_2O \rightarrow 4H_2O_2+Na_2B_4O_7+2NaOH \quad (2)$$

The sodium perborate performs a dual function: on the one hand borax and soda lye can stabilize the pH-value of the dyeing bath in the desired dyeing range. The buffer capacity of the borax is based on the hydrolytic dissociation to give a polyboric acid with a low water content. It will become clear from the reaction diagram set out hereinafter that an equilibrium is achieved when borax and soda lye are present. Upon consumption of soda lye for the saponification of oligomers, further borax can be dissociated, that is to say the pH-value is maintained:

$$Na_2B_4O_7+(1+x)\ H_2O \rightarrow 2B_2O_3 \cdot x\ H_2O+2OH+2Na^+ \quad (3)$$

On the other hand at the dyeing temperature sodium perborate liberates $H_2O_2$ and thus acts as an oxidation agent, thereby counteracting reductive procedures which can have an adverse effect on the dyeing result in an alkaline process. In particular the operating procedure resists dehalogenation of the dyestuffs due to heavy metals under reductive conditions. Many other fiber impurities can have a dyestuff-destroying reductive potential, which is counteracted by the hydrogen peroxide produced. Thus in accordance with the invention sodium perborate acts as a dyestuff stabilizer. In contrast oxidation of the dyestuffs, as is desirable for the purposes of regeneration of the color pigment for example when dyeing cellulose fibers with vat dyestuffs is precisely to be avoided in accordance with the present invention. So that the dyeing result is not adversely influenced by oxidation of the dyestuffs, which is undesirable in this case, the concentration of sodium borate that can be used is limited. Experiments have shown that a buffer system only on a sodium perborate basis cannot have the required buffer capacity without the dyeing result being adversely influenced by damage to the dyestuffs. In accordance with the invention therefore two buffer systems are proposed in order to attain the required buffer capacity without involving adverse influences on the dyestuffs.

A further advantage in using perborate is that the oxidation agent is liberated only when the temperature of the dye bath is increased; influences on the dye bath when cold are thus eliminated. It will be appreciated that, besides sodium perborate, it is also possible to envisage the use of perborate salts with other cation partners.

The selected buffer systems together have a sufficiently high capacity, they are suited in the optimum fashion for the desired pH-range (around pH 9.3), they are ecologically harmless and they can be used on a large engineering scale.

In accordance with a desirable embodiment of the invention it can also be provided that sodium chloride is added to the buffer mixture. By virtue thereof, the glycine is held in solution, by virtue of the furnishing of corresponding ions of opposite charge to the ionic groups of the glycine. That prevents the amphoteric ions agglomerating due to mutual attraction. In principle it is also possible to use other ionic compounds for that purpose. The NaCl does not have a direct influence on the buffer effect. In order to keep the level of ion concentration in the dye bath as low as possible and to prevent precipitation of the dyestuff, NaCl is preferably added at most in a stoichiometric relationship with glycine. In contrast, NaCl is used in known dyeing processes so that the dyestuff draws out of the dye solution onto the fibers due to displacement of the solubility equilibrium or does not become dissolved in the dye solution again. The levels of concentration used for that purpose are markedly above the levels of NaCl concentration proposed in accordance with the principles of the present invention.

A further aspect of the invention involves the addition to the dye bath of a sequestering agent with the substantial constituents nitrilotriacetic acid and polycarboxylates. That combined sequestering agent binds polyvalent metal ions and heavy metals as well as constituents such as salts forming hardness in water, which can have an adverse influence on the dyeing result. The sequestering agent with the constituents nitrilotriacetic acid and polycarboxylates has proven to be particularly effective in the pH-range of between 9 and 10 without any indication of a negative influence on the dyestuffs, for example demetalization or precipitation of the dyestuffs. This particularly good sequestering effect using a minimal amount thereof is to be attributed, without limiting effect in this respect, to the use of the different conditional stability constants of the two sequestering agents for different cations in the pH-range which is of interest. Thus nitrilotriacetic acid has a sequestering effect of about 200 mg/l for $Ca^{2+}$ in the pH-range of between 9 and 12 of interest, whereas the optimum sequestering effect of about 300 mg/l for $Fe^{3+}$ is at a pH-value of between 1.5 and 3. This is compensated by the use of a carboxylate with a sequestering effect of only about 60 mg/l for $Ca^{2+}$ at pH of between 8 and 10, but about 550 mg/l for $Fe^{3+}$ at a pH of between 9 and 12. Accordingly nitrilotriacetic acid is especially suitable for $Ca_{2+}$-ions whereas the carboxylate is better suited to the sequestering of $Fe^{3+}$-ions. The sequestering agent is preferably used in conjunction with the above-indicated buffer system but it can already lead to a considerable improvement in the dyeing result when used in isolation.

In an advantageous embodiment of the invention the initial pH-value of the dyeing process can be in the range of between about 9.3 and 9.4. The majority of available dispersion dyestuffs is still sufficiently stable in that pH-range.

Furthermore, it can be provided in an advantageous embodiment of the invention that the final pH-value of the dyeing procedure does not fall below a value of 9.0. That is achieved by a suitable buffer capacity. That reliably prevents precipitation of oligomers which are already in solution, towards the end of the dyeing procedure, for below pH of 9.0 the oligomers and the decomposition products thereof are no longer soluble with falling temperatures in the dyeing cooling process. The ratio of concentration of glycine to soda lye (33%) in the buffer mixture can preferably be about 1.9 or less. The amount of soda lye is to be so matched that an initial pH-value of between 9.3 and 9.4 is attained. The amount of glycine determines the buffer capacity for compensation of alkali-consuming substances.

The ratio of concentration of glycine to sodium chloride is preferably about 1.3.

In accordance with a further aspect of the present invention the foregoing and other objects are also attained by a dyeing adjuvant which contains glycine and/or a glycine derivative, a lye and a perborate salt. It will be appreciated that the lye which is preferably soda lye can also be added separately prior to the dyeing procedure.

The dyeing process according to the invention is suitable both for pure polyester fibers and also for mixed fibers, for example polyester/cellulose fiber mixes.

DETAILED DESCRIPTION OF THE PREFERRED EMBODIMENT

The objects, features and advantages of the dyeing process and dyeing adjuvant according to the invention will be described in greater detail hereinafter with reference to an Example of the invention.

EXAMPLE

A process for dyeing 100 g of textile material comprising pure polyester fibers in a liquor ratio of 1:10 involves the use of a dye bath with the constituents set out hereinafter contained therein, with the balance being water.

In that respect the precise amounts used are to be matched to the water contents and the level of concentration of foreign substances and impurities in the material to be dyed:

between 2.5 and 1.3 g of glycine;

between 1.9 and 0.8 g of NaCl;

0.1 g of sodium perborate;

between 0.3 and 0.15 g of the sequestering agent containing polycarboxylates, under the trademark PERIQUEST BSD (manufactured by: Dr. Petri);

between 1.2 and 0.6 g of nitrilotriacetic acid;

addition of soda lye until an initial pH-value of between 9.3 and 9.4 is attained;

1.0 g of dispersing agent;

dyestuff trichromatism with a high level of stability in the dye pH-range;

0.5 g DOROSPERS YELLOW KHM *;

0.7 g DOROSPERS RED KRG *; and 0.3 g DOROSPERS BLUE KGN *.

The textile material is dyed, using the above-indicated dye bath, by means of a conventional high-temperature dyeing procedure at a temperature of about 130° C. in a suitable dyeing apparatus. Only a hot rinsing operation is then required. That affords a reproducible dyeing effect with technologically improved textile material.

The effect of the dyeing process in accordance with the principles of the present invention will be described in greater detail hereinafter by reference to the following Comparative Examples:

COMPARATIVE EXAMPLE 1

The following comparison of the buffer system of glycine and soda lye with that of soda lye and borax, trisodium phosphate and potassium hydrogen phosphate shows that there is a constancy in respect of the pH-value with at the same time stability in respect of the dyestuffs involved, as is confirmed by a very slight deviation in relation to the acid reference dyeing, only in the case of the system first referred to above. There is also a clear fall in the pH-value when using exclusively alkali.

Influence of the kind of alkali on dyestuff stability and pH consistancy

| | DOROSPERS YELLOW BRA * | | | DISPERSOL ORANGE C-GL ** | | |
|---|---|---|---|---|---|---|
| | Color shade difference relative to reference dyeing | | | Color shade difference relative to reference dyeing | | |
| Kind of alkali (amount = pH 9.4) | Delta C | Delta H | Final pH | Delta C | Delta H | Final pH |
| 0.16 g/l NaOH 33% | −1.51 | 0.57 | 8.2 | −2.82 | 0.20 | 8.4 |
| 0.2 g/l $Na_2CO_3$ | −2.19 | 1.14 | 8.8 | −3.18 | −1.23 | 8.7 |
| 0.3 g/l $Na_3PO_4$ | −0.96 | −0.49 | 8.1 | −3.90 | −2.96 | 8.2 |
| 0.06 g/l $Li_2CO_3$ | 0.23 | 0.65 | 8.7 | −2.12 | −1.31 | 8.9 |
| Dye bath of the invention | 0.35 | 0.48 | 9.2 | −0.90 | −0.03 | 9.2 |
| 3.2 g/l tripotassium phosphate | −1.96 | 1.39 | 8.1 | −3.48 | 1.49 | 8.2 |
| 1.5 g/l potassium dihydrogen phosphate | | | | | | |
| 0.05 g/l trisodium phosphate | 1.32 | 0.25 | 7.8 | 0.54 | 1.45 | 7.7 |
| 0.75 g/l NaOH 33% + 2 g/l borax | −11.73 | 4.43 | 8.8 | −6.05 | 2.43 | 9.0 |

* Trademark, produced by M. Dohmen GmbH (DE)
** Trademark, produced by BASF AG (DE)

Reference dyeing and the alkaline dyeing operations are implemented on knitted polyester crepe. Acid dyeing is effected using 1 g/l SETAMOL WS (Trademark, produced by BASF AG, Ludwigshafen) employing a pH-value of 4.5 by adjustment with acetic acid.

Colorimetric evaluation of the color difference is reproduced on the basis of the CIELAB-values Delta C and Delta H.

COMPARATIVE EXAMPLE 2

It is to be shown hereinafter how the oxidizing agent LUDIGOL (Trademark, produced by BASF AG, Ludwigshafen), perborate and iodate can remove the reduction effect of glucose. As can be seen from the color differences (in ΔL and ΔH) perborate in a concentration of 0.1 g/l already has a sufficient oxidation potential but it does not have any negative effects in the absence of reducing agents.

| 1 g/l LUDIGOL | | 2 g/l LUDIGOL | | 5 g/l LUDIGOL | | 10 g/l LUDIGOL | | 10 g/l LUDIGOL; without glucose | |
|---|---|---|---|---|---|---|---|---|---|
| ΔL | ΔH | ΔL | ΔH | ΔL | ΔH | ΔL | ΔH | ΔL | ΔH |
| −1.53 | −2.64 | −1.52 | −2.45 | −0.44 | −1.26 | −0.63 | −1.42 | −2.85 | −5.13 |
| 0.1 g/l Perborate | | 0.2 g/l Perborate | | 0.3 g/l Perborate | | 0.4 g/l Perborate | | 1 g/l Perborate | |
| ΔL | ΔH | ΔL | ΔH | ΔL | ΔH | ΔL | ΔH | ΔL | ΔH |
| −0.38 | −0.91 | −0.18 | −0.89 | −0.33 | −0.95 | −0.20 | −1.02 | −0.53 | −1.41 |
| | | | | | | ΔL | | ΔH | |
| 1 g/l perborate; without glucose | | | | | | −1.05 | | −0.99 | |
| 0.05 g/l Iodate | | 0.1 g/l Iodate | | 0.5 g/l Iodate | | 1 g/l Iodate | | 2 g/l Iodate | |
| ΔL | ΔH | ΔL | ΔH | ΔL | ΔH | ΔL | ΔH | ΔL | ΔH |
| −0.35 | −1.04 | −0.31 | −1.11 | −0.35 | −0.99 | −0.07 | −0.48 | 0.10 | −0.38 |
| | | | | | | ΔL | | ΔH | |
| 2 g/l iodate without glucose | | | | | | −2.84 | | −4.94 | |

I claim:

1. A process for dyeing textile material having polyester fibers comprising treating the textile material in an alkaline dye bath containing a dispersion dyestuff at a temperature above 100° C., adjusting the pH-value of the dye bath by the addition of a buffer mixture comprising at least one substance selected from the group consisting of glycine and a glycine derivative and a lye prior to the commencement of the dyeing operation, and adding a perborate salt to the dye bath so that the pH-value is kept substantially constant from the commencement to the conclusion of the dyeing operation.

2. A process as set forth in claim 1 wherein the pH-value of the dye bath is adjusted by the initial addition of said buffer mixture, which buffer mixture comprises glycine and soda lye prior to the commencement of the dyeing operation, and wherein said perborate salt is sodium perborate that is added to the dye bath prior to the commencement of the dyeing operation so that the pH-value is kept substantially constant from the commencement to the conclusion of the dyeing operation.

3. A process as set forth in claim 1 wherein sodium chloride is added to the buffer mixture.

4. A process as set forth in claim 1 wherein a sequestering agent including nitrilotriacetic acid and at least one other polycarboxylate is added to the dye bath.

5. A process as set forth in claim 1 wherein the initial pH-value of the dyeing procedure is in a range of between about 9.3 and 9.4.

6. A process as set forth in claim 1 wherein the final pH-value of the dyeing procedure does not fall below a value of 9.0.

7. A process as set forth in claim 2 wherein the ratio of the concentration of said glycine to said soda lye in the buffer mixture is about 1.9, said soda lye being soda lye (33%).

8. A process as set forth in claim 2 wherein the ratio of the concentration of said glycine to said soda lye in the buffer mixture is below 1.9, said soda lye being soda lye (33%).

9. A process as set forth in claim 2 wherein the concentration of said sodium perborate in the dye bath is about 0.1 g/l.

10. A process as set forth in claim 3 wherein the ratio of the concentration of said glycine to said sodium chloride is about 1.3.

11. A process for dyeing textile material having polyester fibers, comprising providing an alkaline dye bath containing a dispersion dyestuff, adding a perborate salt to the dye bath, adjusting the pH-value of the dyebath by the addition of a buffer mixture comprising at least one substance from the group consisting of glycine and a glycine derivative and a lye prior to the commencement of a dyeing operation so that the pH-value is kept substantially constant from the commencement to the conclusion of the dyeing operation, and treating the textile material in said dye bath at a temperature above 100° C.

* * * * *